US005557260A

United States Patent [19]

Legaz et al.

[11] Patent Number: 5,557,260

[45] Date of Patent: Sep. 17, 1996

[54] SYSTEM FOR THE MONITORING AND DETECTION OF HEAT SOURCES IN OPEN AREAS

[75] Inventors: Antonio C. G. Legaz; Francisco J. E. Duran; Augel J. G. Maraáu, all of Cadiz, Spain

[73] Assignee: Empresa Nacional Bazan de Construcciones Naval Militares, S.A., Spain

[21] Appl. No.: 193,998

[22] Filed: Feb. 9, 1994

[30] Foreign Application Priority Data

Feb. 10, 1993 [ES] Spain ..... 9300267

[51] Int. Cl.[6] ..... G08B 17/12

[52] U.S. Cl. ..... 340/578; 340/556; 348/33; 348/164; 348/159

[58] Field of Search ..... 348/33, 164, 159; 340/578, 565, 555, 556, 870.08

[56] References Cited

U.S. PATENT DOCUMENTS 4,567,367 1/1986 Brown de Colstorun et al. .... 340/505

4,800,285 1/1989 Akiba et al. ..... 340/578

5,133,605 7/1992 Nakamura ..... 348/164

5,160,842 11/1982 Johnson ..... 340/578

FOREIGN PATENT DOCUMENTS 9109390 6/1991 WIPO ..... 340/578

*Primary Examiner*—John K. Peng
*Assistant Examiner*—Daniel J. Wu
*Attorney, Agent, or Firm*—Wigman, Cohen, Leitner & Myers, P.C.

[57] ABSTRACT

A system for the monitoring and detection of heat sources in open areas comprising an integrated assembly of observatories which include autonomous means (2) of infrared vision (11) and diurnal vision (12) and which are linked to a central control station (1) where the images are processed in real time for the automatic detection of heat sources, in particular fires, within a certain area of coverage. The system can be applied to the automatic detection of forest fires in areas of several square kilometres.

18 Claims, 3 Drawing Sheets

SYSTEM FOR THE MONITORING AND DETECTION OF HEAT SOURCES IN OPEN AREAS

The present invention relates to a system for detecting heat sources in open areas, in particular for the automatic detection of fires, such as forest fires, in open areas of several square kilometres.

BACKGROUND OF THE INVENTION

One of the main problems associated with the fight against forest fires is the delay before any action is taken, due in part to the lack of automatic mechanisms which can provide early detection.

Current procedures for the detection of forest fires are, in most cases, based on the use of human means for monitoring zones in which fire is a potential danger and only in rare cases on systems based on directional sensors which can raise the alarm if the level of radiation exceeds a predetermined limit. These systems suffer from a number of drawbacks, for example:

- They are unable to process a given observation zone in parallel and in real time.
- They are unable to identify and classify the heat sources.
- The information generated by the sensor is low quality, above all in terms of spatial resolution.
- The information refresh frequency is low.
- It is impossible to display the information coming from the sensor to an operator as a real time image on a screen.
- As a result of the above the detection efficiency of these systems is reduced in terms of speed of response and the probability of the occurrence of false alarms.

The European Patent 117162 describes a heat source detection system which is based on an infrared sensor element which makes a circular scan step by step. The occurrence of a heat source is detected by sending the information coming from the sensor to a remote station where, for each point, the intensity of the signal from the sensor is compared with that which was recorded during the previous scan, generating an alarm if a certain limit is exceeded.

The need to displace the sensor mechanically and step by step over each point of the zone being monitored, together with the unidimensional nature of the sensor itself, means that the system is slow, low in resolution and liable to create false alarms.

The patent PCT W091/09390 describes a fire-fighting system based on observatories which are also provided with infrared sensors with the addition of diurnal cameras. Fires are detected at the observatory itself which is therefore more complex and as such less reliable than if carried at a remote control station. The drawbacks associated with using infrared sensors instead of infrared vision cameras are the same as those described with reference to the patent EP117162.

SUMMARY OF THE INVENTION

The object of the present invention is to provide a system which enables the occurrence of heat sources identifiable as "fires" to be detected quickly and accurately, generating an alarm signal, and at the same time provide information concerning its geographic location and other useful parameters which will help in making the decisions about the means which should be employed in order to extinguish the fire in question.

The system of the invention is based fundamentally on:

- The use of infrared vision cameras as the main observation element for generating thermal images and diurnal vision cameras to help with detection and identification. At each instant the cameras produce two-dimensional information about a scene within the zone assigned to the observatory.
- The use of original and specific digital image processing algorithms for detecting the heat sources. This gives improvements in the image, filtering, segmentation, data fusion, correlation, etc.
- Displaying the scenes captured by the vision cameras on a monitor such that they can by supervised by an operator.
- The use of un-manned observatories of minimum complexity so that they can be transportable and autonomous as far as energy is concerned. This factor also implies greater reliability and reduced cost.
- The concentration of the digital processing of the images from the various observatories in one control station which has unlimited space and energy and can therefore be fitted with equipment with higher processing capacity and consumption than in the remote and isolated observatories. This gives greater reliability, easier maintenance and reduced cost.

According to the present invention, the detection system consists of several vision subsystems situated in observatories and a control station subsystem and is provided with the communications facilities and power supplies necessary for its operation.

Its operation is based on the digital processing in the control station of the images generated by the infrared and diurnal vision cameras which are situated in the observatories and used as heat source sensor elements.

Each vision subsystem transmits video, state and camera position information to the control station.

The thermal and visible images are processed and displayed in the control station in order to identify the occurrence of heat sources.

A processor situated in the control station controls the operation of the system as a whole and generates the operating parameters of each observatory.

During normal operation the positioner of each vision subsystem carries out a continuous orientational and elevational programmed exploration sequence across the monitored zone assigned to the observatory. This sequence is can be interrupted in the event of an alarm or manually as required by the system operator.

If a heat source occurs and its parameters identify it as a "fire", the system generates an alarm signal together with the geographic position and other useful data regarding the heat source detected, such that decisions can be made more easily and the means available can be put to the most effective use in order to extinguish the fire.

The video images and the information regarding position and state from each observatory are available to the system operator simultaneously, in particular those from the observatory at which the alarm was raised.

Alarm inhibition zones can be defined within the area of coverage of the system to prevent known or controlled heat sources from producing false alarms.

Under normal operating conditions each observatory provides a radius of coverage of over 10 km for fire sources or heat sources of 1 $m^2$ and temperatures of over 400° C., although this coverage depends on the size of the heat source and its temperature and can be much greater in the case of a typical source (10 $m^2$).

BRIEF DESCRIPTION OF THE DRAWINGS

In order that the characteristics of the present invention be better understood, the accompanying drawings show by way of a non-limiting example one practical embodiment thereof.

In the drawings.

DESCRIPTION OF A PREFERRED EMBODIMENT

As has already been indicated the monitoring system which forms the object of the invention comprises a number of autonomous and transportable vision subsystems and a control and image processing station.

Figure 1:
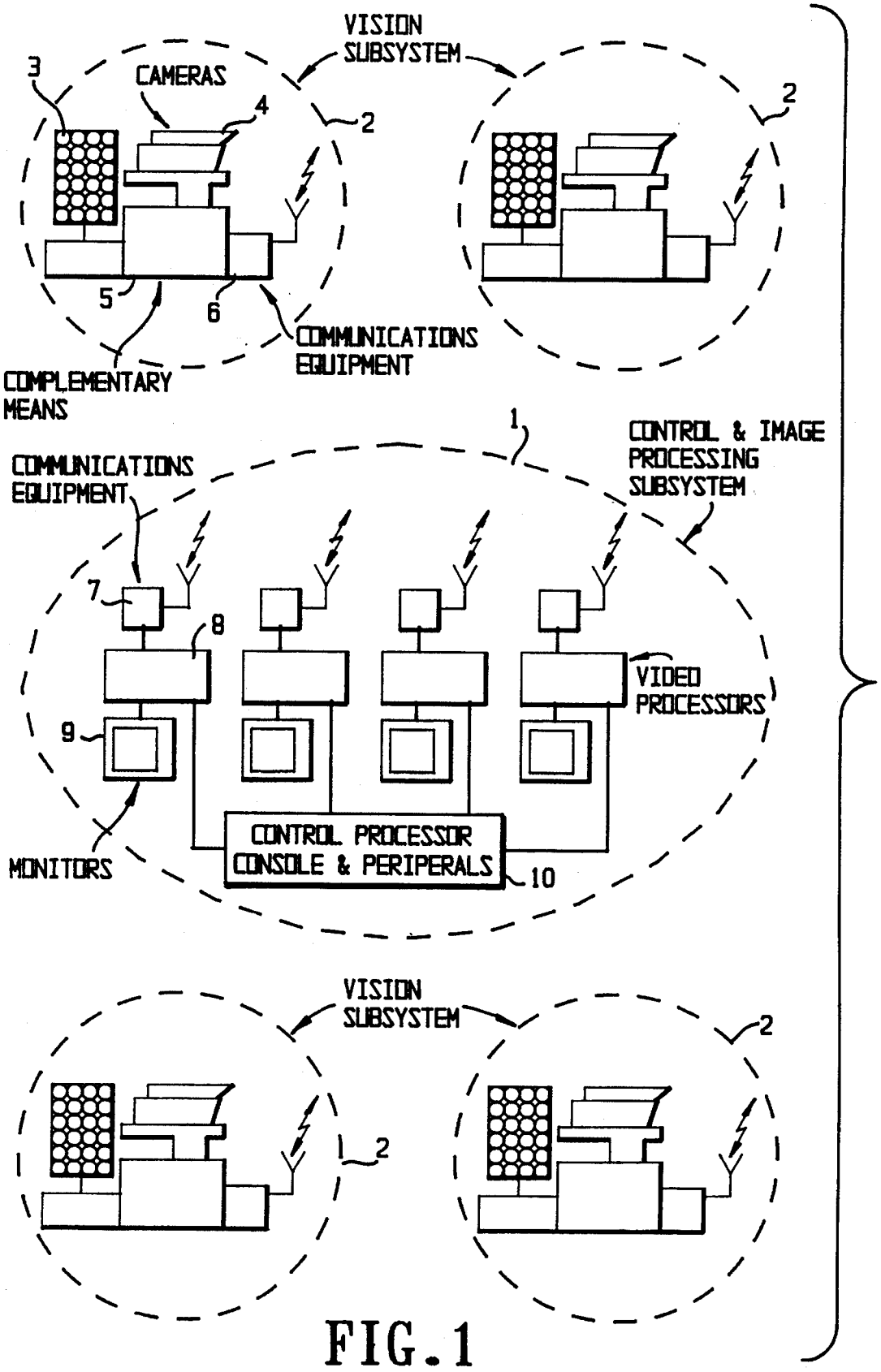
FIG. 1 is a diagram of a complete installation for the monitoring and detection of fires comprising four vision subsystems and one control station subsystem.
Figure 2:
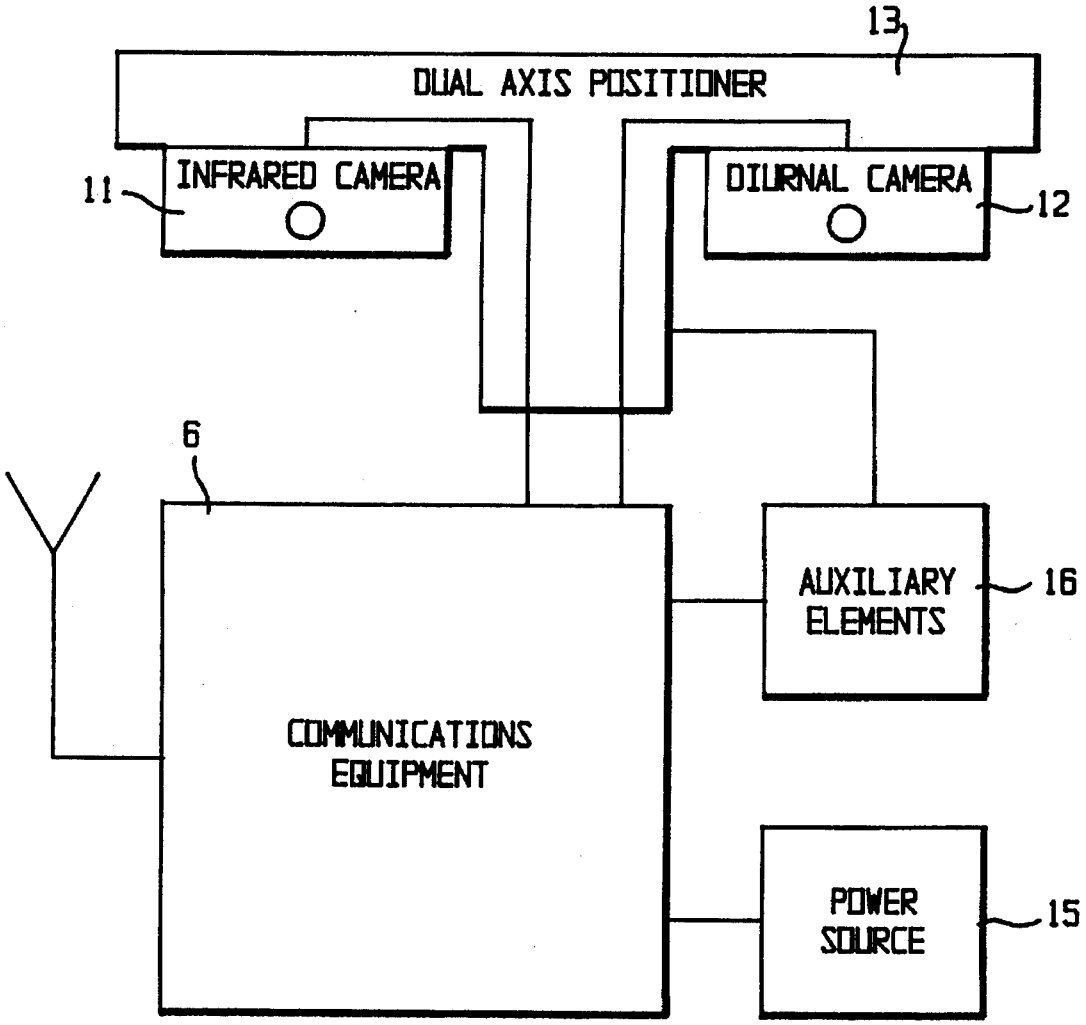
FIG. 2 is a block diagram of one of the vision subsystems shown in FIG. 1 and which are distributed throughout the zone being monitored.
Figure 3:
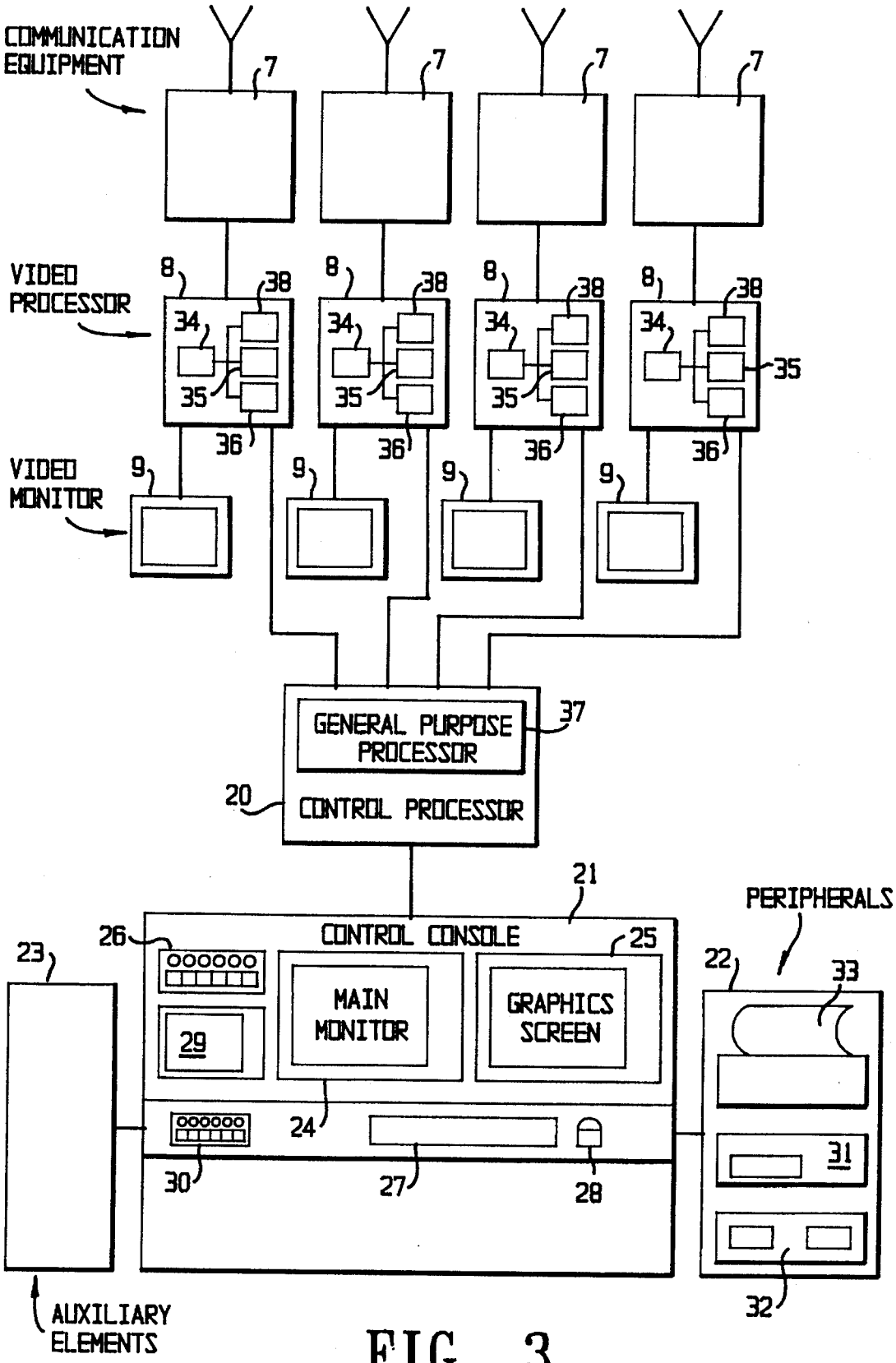
FIG. 3 is a block diagram of the control station subsystem shown in FIG. 1 where the processes of heat source detection and generating alarms are centralized.

In the example shown in FIGS. 1–3 the subsystem includes a control and image processing subsystem 1 and four vision subsystems 2.

Each vision subsystem 2 includes an electrical power source which, in the example shown in the drawing, is represented in the form of a solar panel 3 but which could of course be of a different type depending on what is available, the conditions required, etc. Each vision subsystem further includes cameras 4, complementary means 5 and communications equipment 6.

The control and processing station 1 includes communications equipment 7, video processors 8 and monitors 9 as well as a control processor 20 (FIG. 3), a control console 21 (FIG. 3), peripherals and auxiliary elements 23 (FIG. 3) which are indicated collectively by the number 10 in the figure.

Each vision subsystem 2 is a compact, autonomous and transportable system which can be installed outside. As FIG. 2 shows, each vision subsystem comprises an infrared vision camera 11, a diurnal vision camera 12, a dual-axis positioner 13, communications equipment 6, an electrical power source 15 and auxiliary elements 16.

The infrared vision camera 11 consists of a solid state array type device which is sensitive to infrared radiation, the associated electronics, brightness and contrast controls, standard format video and synchronization outputs and optics with adjustable zoom and iris, suitable for assembly outside.

The diurnal vision camera 12 consists of a solid state array type device which is sensitive to the visible spectrum, the associated electronics, brightness and contrast controls, standard format video and synchronization outputs and optics with adjustable zoom and iris, suitable for assembly outside.

The dual-axis positioner 13 constitutes the support for the infrared and diurnal vision cameras and is provided with two axes for azimuth and elevational movement, two electric motors and angular position transducers. As before, the positioner is suitable for assembly outside.

The communications equipment 6 forms the information exchange support between the vision subsystem and the control station. The communication channels are: two unidirectional video channels from the vision subsystem to the control station, a bi-directional channel for digital data and a bi-directional audio channel.

If radio communication links are used, the communications equipment 6 comprises a modulator, a transmitter and an antenna for sending the video signals to the control console and a modem, a transmitter/receiver and an antenna for the exchange of digital data between the vision subsystem and the control station. It is also possible to use the video channel to transmit data to the control station using a subcarrier.

If wire communication links are used the modulated and amplified video signals are sent directly along the appropriate coaxial cable and the digital communications are carried out by means of a modem and telephone link.

It is also possible to use fibre optics as the communications medium for the data and video signals.

Finally, it is also possible to use systems consisting of a mixture of those described above.

The power source 15 comprises a system for generating and storing electrical energy and is based on solar panels, wind-driven generators etc., batteries, control electronics for charging the batteries and monitoring their condition, as well as output converters for providing the required supply voltages.

Finally, the auxiliary elements 16 consist of the necessary electronics for either remotely or locally controlling the motors of the positioner 13 and acquiring positional data from the angular transducers and other signals to do with the condition of the vision subsystem 2, the local control panel for the positioner and cameras, the serial coder for the data to be sent to the control station 1 and the decoder for the commands received from said station, the external housing, mechanical fixing accessories, a cooling system and cables.

FIG. 3 shows a block diagram of a control and image processing station 1 for a system with four vision subsystems.

According to the example shown in FIG. 3, the control station includes a video processor 8 and a set of communications equipment 7 for each vision subsystem, a control processor 20, which includes general purpose processor 37, a control console 21, peripherals 22 and auxiliary elements 23.

Each video processor 8 consists of a processor whose specific application is digital image processing. Basically it comprises the following elements: an infrared/visible video selector, a video digitizer, a central processing unit 34 with a resident programme, input/output interfaces and a video monitor 9.

The analogue video signal from the infrared or diurnal camera of the vision subsystem is digitized in real time by means of an analogue-to-digital converter 38 and stored frame by frame in a specific video memory 35 which can be accessed by the central processing unit 34. The programmes resident in the central processing unit implement image analysis algorithms and algorithms for extracting the characteristics which are useful for the detection, classification and identification of heat sources. Once processed, the digital video signal is converted 36 to analog form in order to display the image from the vision subsystem to the operator on a video monitor. Artificial video signals generated by the video processor are superimposed on the video signal from the camera in order to highlight the areas of interest in the scene and give an indication of the conditions.

The control processor 20 is a general purpose processor with a resident programme for controlling and supervising the entire system. It is provided with the necessary input/output interfaces for integrating with the communications equipment 7, the video processors 8, the control console 21 and the peripherals 22.

The control console 21 constitutes the man/machine interface between the operator and the system and consists of a video array, not shown, a main video monitor 24, a graphics screen 25, an alarm panel 26 and a control panel.

The video array comprises at least as many inputs as there are vision subsystems and at least three outputs, one for the main monitor, another for the video recorder and a third, auxiliary output for transmitting video signals to a remote point. At each instant, the control processor 20 selects the input associated with each of these outputs.

The main video monitor 24 is larger than the other monitors and displays the video signal chosen by the operator, said video signal coming from any of the vision subsystems or from the output of the video recorder.

The graphics screen 25 is able to display geographic maps of the zone being monitored as well as useful information for controlling the fire extinguishing means.

The alarm panel 26 contains visual and acoustic signalling elements to indicate pre-alarm and alarm conditions generated by the video processors 8.

The control panel constitutes the man/machine interface for the general control and supervision of the system and is connected directly to the control processor 20. Physically, it consists of an alphanumeric keyboard 27, manual positioning elements (joystick) 28, data display screen 29 and an assembly of indicators and selection switches 30.

The control station is further provided with a set of communications equipment 7 for each vision subsystem, the characteristics of the equipment matching those of the communications equipment of the vision subsystem.

The video recorder/player 31 provides a means of recording the video signal from any of the cameras. The digital data and the information about the condition of the system are recorded onto the sound channel in synchronization with the image. The video signal is displayed on the main monitor 24. It is provided with manual control and automatic control from the control processor 20.

The mass data storage device 32, which can be optical or magnetic, contains the historical data base of the system and the operational parameters.

The printer 33 comprises any paper recording device and constitutes the principal means of recording events, mainly alarms.

The characteristics of the auxiliary elements 23 depend to a large extent on the size of the system. Basically, these elements include an uninterruptable power supply system, air conditioning, cupboards and the rest of the equipment which is necessary to provide support for the elements described above.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A system for the monitoring and detection of heat sources in open areas, in particular for the detection and identification of fires in open areas of greater than one square kilometer, comprising a plurality of autonomous transportable vision subsystems and a central station for control and image processing, said vision subsystems including infrared and diurnal remote vision cameras each producing a respective video signal, positioners and complementary means, and which are located in observatories distributed throughout a zone to be monitored, and a communications module, said central station being where processing of images received from the vision subsystems is centralized and where the general operation of the system is monitored and controlled; said central station comprising video processors which digitally process infrared and diurnal images received from the remote vision cameras, said central station displaying said digitally processed images to produce an alarm when a heat source develops; and wherein said central station comprises at least one control processor, plural video processors, and a number of sets of communications equipment equal to the number of vision subsystems, and a control console including a main video monitor which displays a video signal chosen by the operator from one of the vision subsystems or the video recorder, a graphics screen which can display maps and information about the zone being monitored, an alarm panel provided with signalling means for indicating pre-alarm and alarm conditions generated by the video processors, and a control panel which constitutes the man/machine interface for the general control and supervision of the system.

2. A system according to claim 1, said control processor comprising a general purpose processor with a resident program for controlling and supervising the system and provided with input/output interfaces for integrating with the communications equipment, the video processors, the control console, and the peripherals.

3. A system according to claim 1, wherein the characteristics of each set of communications equipment match those of the communication module of an associated vision subsystem.

4. A system according to claim 1, wherein the central station further includes a video recorder/player for recording a video signal received from one of the cameras and displaying a recorded signal on the main video monitor, mass data storage devices which contain the historical data base of the system and the operational parameters, and paper recording devices.

5. A system according to claim 1, each vision subsystem further comprising an infrared camera and a diurnal camera, a dual-axis positioner with elevational and azimuth movement and which supports said cameras, control electronics and auxiliary mechanical support elements which includes a housing adapted to provide the subsystem with environmental protection, said positioner carrying out a continuous azimuth and elevational programmed exploration sequence across the monitored zone assigned to the observatory.

6. A system according to claim 5 wherein each vision subsystem further includes electrical power source and communications equipment.

7. A system according to claim 1, each of said video processors comprising a central processing unit with a resident program, and a video monitor.

8. A system according to claim 7, wherein said central processing unit carries out digital image processing in real time in order to detect, identify, and classify heat sources.

9. A system according to claim 7, wherein said video signal received from at least one of the infrared and diurnal cameras is digitized in real time by an analog-to-digital converter and stored frame by frame in a video memory which can be accessed by the central processing unit, and means for converting the processed video signal to analog form in order to be displayed on a video monitor together with graphics and characters generated by the video processor to highlight areas of interest in the image.

10. A system for the monitoring and detection of heat sources in open areas, in particular for the detection and identification of fires in open areas of greater than one square kilometer, comprising a plurality of autonomous transportable vision subsystems and a central station for control and image processing, said vision subsystems including infrared and diurnal remote vision cameras each producing a respective video signal, positioners and complementary means, and which are located in observatories distributed throughout a zone to be monitored, and a communications module, said central station being where processing of images received from the vision subsystems is centralized and where the general operation of the system is monitored and controlled; said central station comprising at least one control processor, plural video processors and a number of sets of communications equipment equal to the number of vision subsystems, and a control console including a main video monitor which displays a video signal chosen by the operator from one of the vision subsystems or the video recorder, a graphics screen which can display maps and information about the zone being monitored, an alarm panel provided with signalling means for indicating pre-alarm and alarm conditions generated by the video processors, and a control panel which constitutes the man/machine interface for the general control and supervision of the system.

11. A system according to claim 10, wherein said video signal received from at least one of the infrared and diurnal cameras is digitized in real time by an analog-to-digital converter and stored frame by frame in a video memory which can be accessed by the central processing unit, and means for converting the processed video signal to analog form in order to be displayed on a video monitor together with graphics and characters generated by the video processor to highlight areas of interest in the image.

12. A system according to claim 10, said control processor comprising a general purpose processor with a resident program for controlling and supervising the system and is provided with input/output interfaces for integrating with the communications equipment, the video processors, the control console, and the peripherals.

13. A system according to claim 10, wherein the characteristics of each set of communications equipment match those of the communication module of an associated vision subsystem.

14. A system according to claim 10, wherein the central station further includes a video recorder/player for recording a video signal received from one of the cameras and displaying a recorded signal on the main video monitor, mass data storage devices which contain the historical data base of the system and the operational parameters, and paper recording devices.

15. A system according to claim 10 wherein each vision subsystem further includes electrical power source equipment.

16. A system according to claim 10, each of said video processors comprising a central processing unit with a resident program, and a video monitor.

17. A system according to claim 16, wherein said central processing unit carries out digital image processing in real time in order to detect, identify, and classify heat sources.

18. A system according to claim 16, wherein said video signal received from at least one of the infrared and diurnal cameras is digitized in real time by an analog-to-digital converter and stored frame by frame in a video memory which can be accessed by the central processing unit, and means for converting the processed video signal to analog form in order to be displayed on a video monitor together with graphics and characters generated by the video processor to highlight areas of interest in the image.

* * * * *